United States Patent [19]

Rahe

[11] Patent Number: 4,534,552

[45] Date of Patent: Aug. 13, 1985

[54] SHEET DIVERTING SYSTEM

[75] Inventor: Thomas E. Rahe, York, Pa.

[73] Assignee: Motter Printing Press Co., York, Pa.

[21] Appl. No.: 516,050

[22] Filed: Jul. 20, 1983

[51] Int. Cl.[3] ..... B65H 29/60; B65H 29/68

[52] U.S. Cl. ..... 271/279; 101/411; 271/204; 271/277; 271/302

[58] Field of Search ..... 271/204, 205, 82, 104, 271/279, 294, 295, 277, 300, 302; 101/410, 411, 232

[56] References Cited

U.S. PATENT DOCUMENTS

| | | | |
|---|---|---|---|
| 3,032,335 | 5/1962 | Crafts | 271/21 |
| 3,075,678 | 1/1963 | Huck | 225/96 |
| 3,459,421 | 8/1969 | Motter | 271/64 |
| 3,999,454 | 12/1976 | Tiso et al. | 83/107 |
| 4,373,713 | 2/1983 | Loebach | 271/303 |

*Primary Examiner*—Bruce H. Stoner, Jr.
*Assistant Examiner*—John A. Carroll
*Attorney, Agent, or Firm*—Brumbaugh, Graves, Donohue & Raymond

[57] ABSTRACT

A sheet diverter system in which a stream of sheets is fed by a pair of tapes to a gripping zone between a pair of separating cylinders. The tapes on opposite sides of the sheet diverge downstream of the gripping zone and wrap around a part of the outer periphery of the adjacent separating cylinder so that they travel at the same velocity as the outer periphery of the cylinder. The sheets advance toward the gripping zone at a velocity controlled by the separating cylinder and successive sheets are presented to the grippers carried by the cylinders so that alternate sheets are carried along different paths to different delivery stations.

3 Claims, 3 Drawing Figures

SHEET DIVERTING SYSTEM

BACKGROUND OF THE INVENTION

This invention relates to a sheet handling system for dividing a stream of sheets into at least two streams of sheets for at least two delivery stations.

Although the present invention has general application in sheet handling systems, it is particularly applicable in printing presses in which webs are printed and folded into ribbons, and the ribbons are cut into folded sheets or signatures. Normally a number of pages are printed by the printing cylinder so that there are a number of different signatures in the stream emerging from the cutter between repeat signatures. The delivery section of the printing press usually separates like signatures and directs them to different conveyors in stacked or overlapping fashion which serve as collection stations for repeat signatures. The signatures are then usually delivered to an inserter for assembling and stitching them in a book.

The conventional delivery section of a printing press includes a plurality of transfer cylinders utilizing pins or grippers to engage the signatures and direct them along appropriate paths of travel to the proper collection stations. These pins and grippers are controlled by actuating means operated in timed relation with the travel of the leading edges of the signatures to insure proper handling.

For example U.S. Pat. No. 3,032,335 shows a folder in which the cylinders 34 and 35 mount pins which impale and hold the free end of the web, knife assemblies to sever the signatures from the web, and tucker blades and folding jaws for putting a transverse fold in each signature. Alternate ones of the signatures are taken from each of the cylinders 34 and 35 by a distributing cylinder, which also slows the signatures. Each distributing cylinder separates successive signatures into two streams of signatures that are fed to longitudinal folders.

U.S. Pat. No. 3,459,421 is similar in that the product is cut off, impaled on pins and folded before being presented to a gripper and slowdown cylinder which separates successive signatures into two streams that are fed to fan wheels by way of additional gripper and slowdown cylinders.

The use of pins to engage and transfer a signature means that the pin holes must be trimmed out and correspondingly less area of the signature is available for printing. Also, perforated signatures tend to stick to each other causing problems in signature handling. Furthermore, folders having knife assemblies installed on the pin cylinders are limited to a fixed cut off length determined by the cylinder diameter and the number of knife assemblies.

U.S. Pat. No. 4,373,713 shows a signature delivery apparatus in which a stream of sheets or signatures are divided into two streams that are supplied to fan wheels, using a pair of rotary diverter cams cooperating with a pair of stationary guide surfaces, guide tapes conducting the signatures between the diverter cams.

This arrangement is limited in its variable size range capability due to the size which the cams must maintain in order to match the surface speed of the tapes, and the placement of the adjacent tape guide rolls so that the signature is always contained in a tape nip. Another difficulty is that a stationary guide is known to mark a printed surface that strikes it at high speed. Also, this arrangement is limited to a single width folder in order to provide accessability to the tapes under the diverter cams.

SUMMARY OF THE INVENTION

The present invention is an improved sheet handling system that has particular application as a signature delivery apparatus for printing presses. This apparatus includes a pair of separating cylinders each mounting grippers arranged so that the leading edges of successive signatures are gripped alternately by the separating cylinders and diverted into two streams of signatures. Sheet feeding tapes guide the signatures to and away from the separating cylinders. This delivery apparatus is preferably downstream of a pinless, variable cutoff folder.

Using grippers instead of pins to transfer a signature allows the signature to contain a larger usable printed area. The grippers will not perforate a signature, and so the bindery trim can be less. Alternatively, if books are untrimmed they will have a more pleasing appearance. Also, the handling of the signatures is improved because non-perforated signatures do not tend to stick to each other as do perforated signatures.

The present delivery apparatus also has a relatively large size range capability compared to arrangements using fixed cutoff folders or rotary diverter cams. Inasmuch as there are no stationary guides, marking of the printed signature surface is avoided. Also, two or more side-by-side streams of signatures may be fed to the present delivery apparatus.

BRIEF DESCRIPTION OF THE DRAWINGS

For a better understanding of the invention, reference is made to the following detailed description of an exemplary embodiment, taken in conjunction with the accompanying drawings, in which.

DETAILED DESCRIPTION OF THE EXEMPLARY EMBODIMENT

Figure 1:
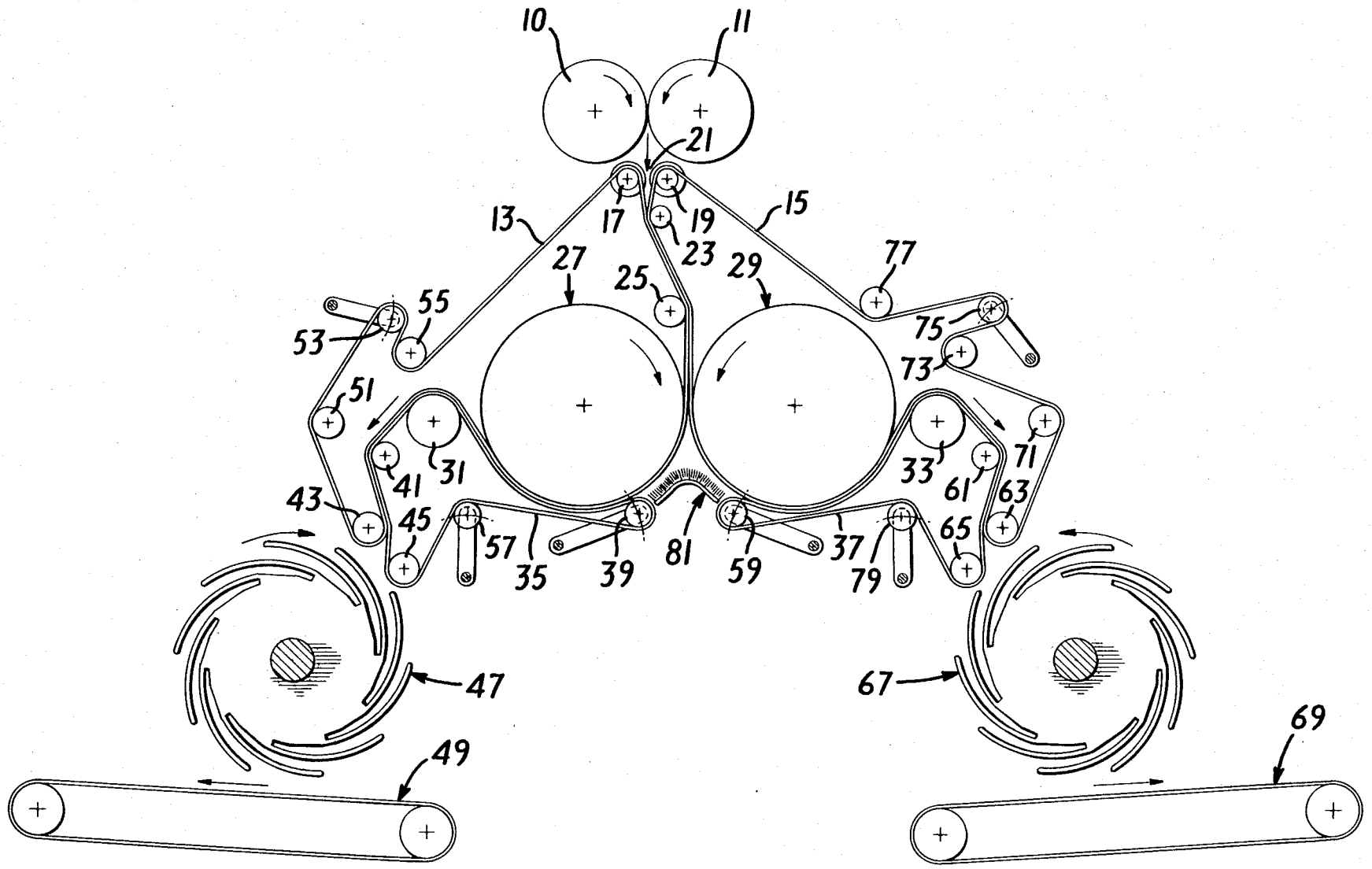
FIG. 1 is a schematic side elevational view of a sheet handling system according to the invention.

The sheet handling system of the present invention shown in FIG. 1 is part of the delivery section of a printing press in which webs are printed, folded into ribbons, and the ribbons are directed between a pair of conventional rotary cutting cylinders 10 and 11 which cut the ribbons into folded sheets or signatures. The folded and cut sheets or signatures, referred to herein generically as sheets, provide the insert pages for a book. Successive sheets printed from different plates are directed to different collection stations where similarly printed sheets are collected. These successive sheets must thus be directed along different paths of flow to their respective collection stations.

The sheet delivery system shown in FIG. 1 diverts successive sheets alternately to a pair of collection stations, but it should be understood that each of the separated sheet streams can, in turn, be divided so that the initial stream or streams of cut sheets can be diverted to as many collection stations as are required.

In the illustrated embodiment there are two side-by-side initial streams of cut sheets that are discharged from the cutting cylinders 10 and 11, and carried between a plurality of sheet feeding tapes 13 and a plurality of sheet feeding tapes 15, each guided in a closed path, the tapes 13 and 15 defining a sheet feeding channel therebetween. To this end, directly downstream of the cutting cylinders the tapes 13, 15 are guided by a pair of rolls 17, 19 in converging paths to form a gap 21 for receiving the cut sheets therein. The tapes 13, 15 are then guided by rolls 23, 25 to carry the streams of cut sheets to a pair of separating cylinders 27, 29, where the cut sheets are alternately diverted in different directions and fed to different collection stations.

The speed of the tapes 13, 15 exceeds that of the cut sheets presented thereto so that the cut sheets are accelerated between rolls 23 and 25 to provide sufficient separation between successive sheets to allow the grippers to extend therebetween. Such acceleration downstream of the cutoff section is well known to those skilled in the art.

The tapes 13, 15 are guided between the separating cylinders 27, 29 and then diverge, the tapes 13 being guided along one path by the cylinder 27 and a guide roll 31, and the tapes 15 being guided along another path by the cylinder 29 and a roll 33.

Downstream of the cylinders 27, 29 a plurality of tapes 35 guided in a closed path cooperate with the tapes 13 to define a sheet feeding channel therebetween and feed the sheets released by the cylinder 27 as will be described below to a first collection station. Similarly, a plurality of tapes 37 guided in a closed path cooperate with the tapes 15 to define a sheet feeding channel therebetween and feed the sheets released by the cylinder 29 to a second collection station.

The tapes 35 are guided by a roller 39 along a converging path with tapes 13 to form a gap for receiving sheets therebetween. The roller 39 is mounted to permit adjustment of the gap between the tapes 13 and 35. The tapes 13, 35 are then guided together by the cylinder 27 and guide rolls 31, 41, 43, 45 to carry the sheets therebetween, releasing the sheets downstream of roll 43 and feeding them into a conventional rotary fan wheel 47, which discharges them onto a conventional creeping belt 49.

The tapes 13 are then directed by a guide roll 51, a spring-biased take-up or tensioning roll 53 and a guide roll 55 back to the guide roll 17 to complete the closed path of the tapes. The tapes 35 are guided by a spring-biased tensioning roll 57 back to the guide roll 39 to complete their closed path.

Similarly, the tapes 37 are guided by a roller 59 along a converging path with the tapes 15 to form a gap for receiving sheets therebetween. The roller 59 is mounted to permit adjustment of the gap between the tapes 15 and 37. The tapes 15, 37 are then guided together by the cylinder 29 and guide rolls 33, 61, 63, 65 to carry the sheets therebetween, releasing the sheets downstream of roll 63 and feeding them into a rotary fan wheel 67, which discharges them onto a creeping belt 69.

The tapes 15 are then returned to the guide roll 19 by guide rolls 71, 73, a spring-biased tensioning roll 75 and a guide roll 77, and the tapes 37 are returned to the guide roll 59 by a spring-biased tensioning roll 79.

A conventional brush guide 81 extends between the rollers 39 and 59 in closely spaced relation to the cylinders 27 and 29. The guide minimizes the whipping around of the trailing ends of the sheets when they are released from between the tapes 13 and 15.

Figure 2:
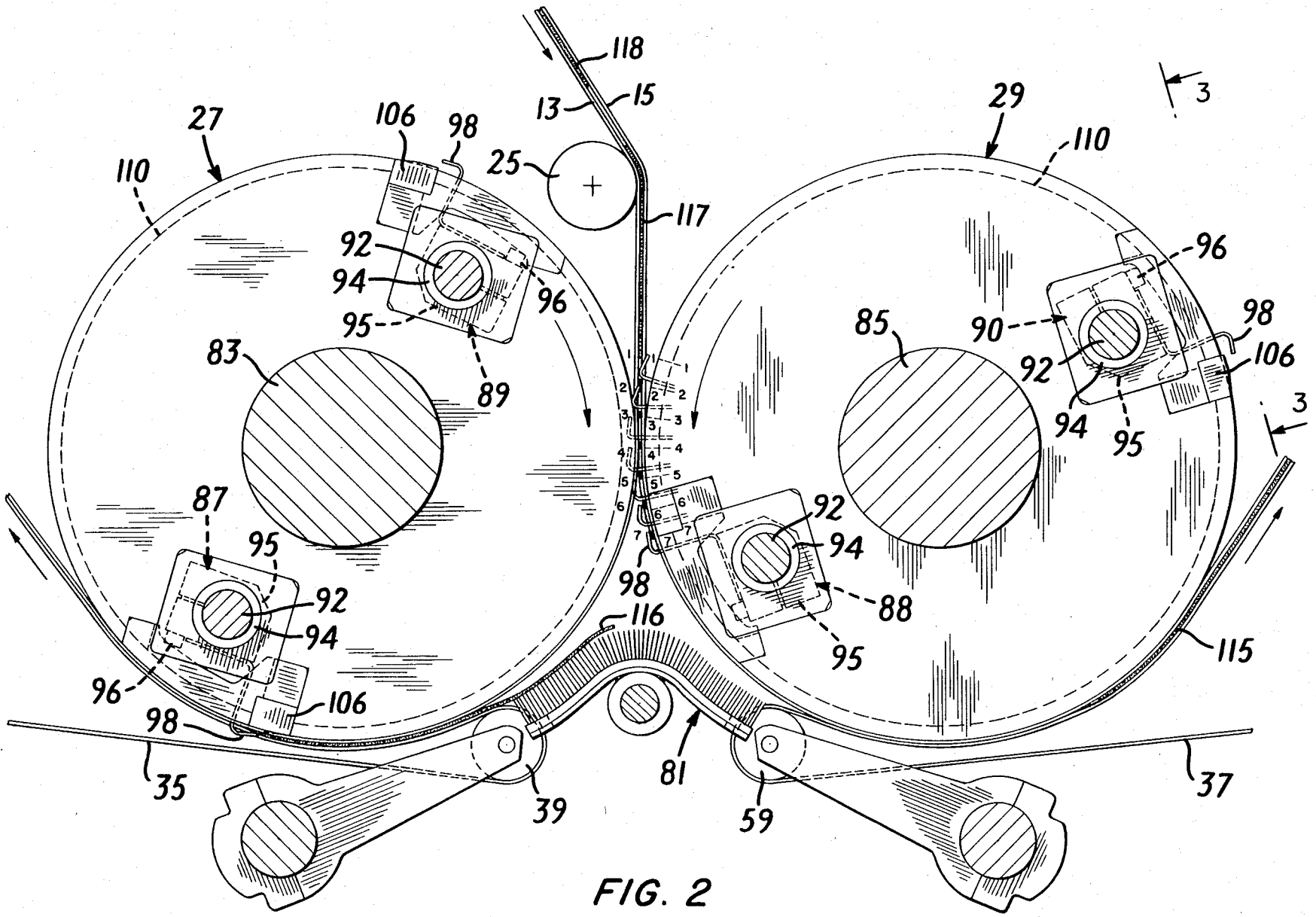
FIG. 2 is an enlarged elevational view of the separating cylinders of FIG. 1.
Figure 3:
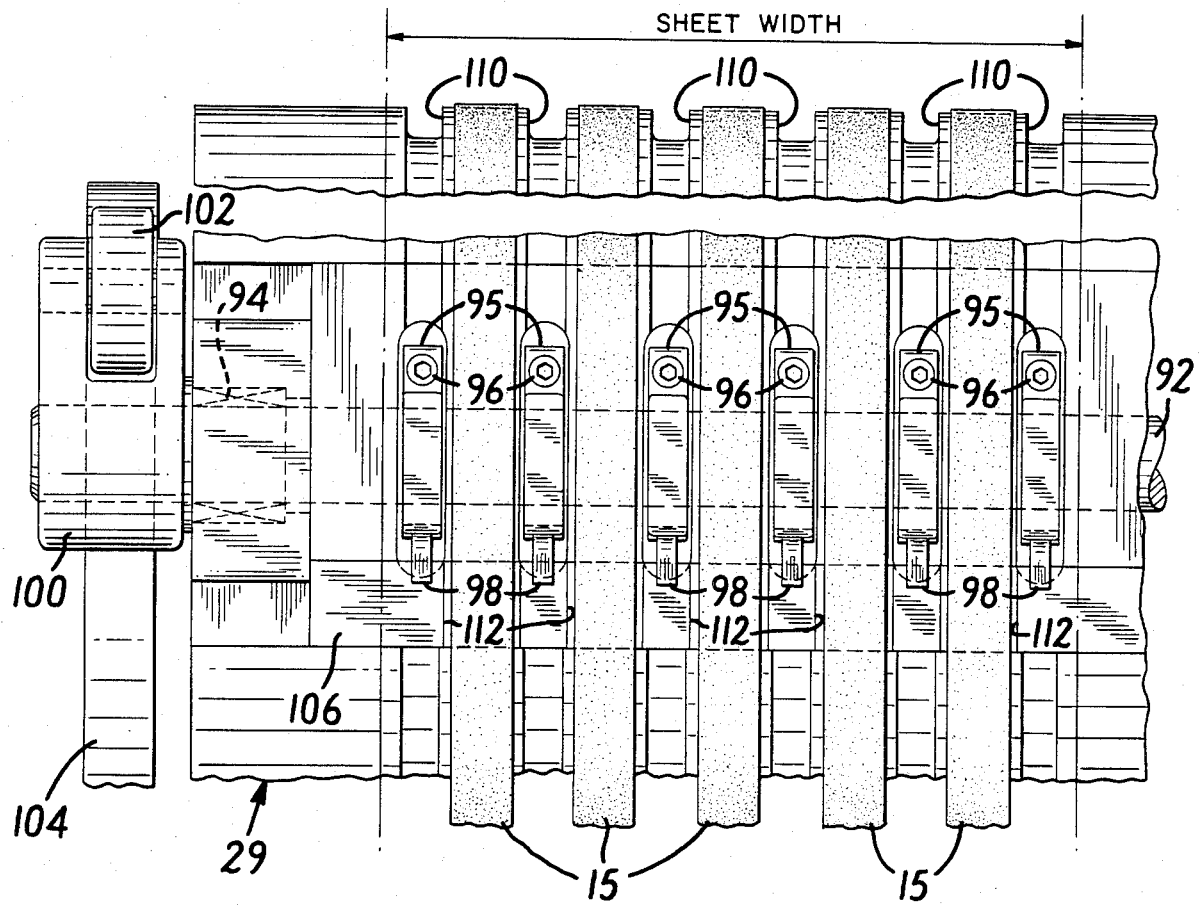
FIG. 3 is a view taken along the line 3—3 of FIG. 2 and looking in the direction of the arrows.

The structure and operation of the separating cylinders 27, 29 are more readily understood by reference to FIGS. 2 and 3. The cylinders 27, 29 are mounted on parallel driven shafts 83, 85, respectively. In the illustrated embodiment, each separating cylinder mounts two gripper mechanisms spaced equidistant around the circumference thereof. Thus cylinder 27 mounts gripper mechanisms 87 and 89, and cylinder 29 mounts gripper mechanisms 88 and 90.

Each gripper mechanism includes a gripper shaft 92 mounted in the respective separating cylinder by a plurality of non-friction bearings 94. A plurality of spaced brackets 95 are clamped to each gripper shaft 92 for rotation therewith by a plurality of screws 96. Each such bracket carries a gripper finger 98, which may be of any suitable design but is preferably of the type described and shown in U.S. patent application Ser. No. 299,650, filed Sept. 4, 1981, and entitled Gripper for Sheet Handling Equipment and owned by the assignee of the present invention.

The gripper shaft 92 extends beyond one end of the respective separating cylinder and receives a lever 100 carrying a cam follower 102. As each separating cylinder is rotated, the two cam followers 102 follow a respective cam 104, which is profiled such that the gripper fingers 98 of each gripper mechanism are simultaneously rotated toward and away from a respective gripper bar 106 so as to engage and release the sheets at the desired locations during the revolution of such separating cylinder. Each gripper bar is mounted in its separating cylinder by a plurality of bolts (not shown) that are recessed so as not to extend beyond the periphery of the cylinder.

Each of the separating cylinders 27, 29 is formed with a plurality of spaced parallel grooves or slots 110 extending around that cylinder to accommodate or receive with clearance the gripper fingers 98 of the other separating cylinder when those gripper fingers are extended to receive a sheet, as are the fingers of the gripper mechanism 88 in FIG. 2. In the illustrated embodiment the grooves 110 of one separating cylinder are in registry with those of the other. Inasmuch as the gripper fingers 98 and grooves 110 of the cylinders 27, 29 are all in registry, the grooves do not extend entirely around the cylinders, but are interrupted by the gripper bars 106.

Where the tapes 13, 15 engage the cylinders 27, 29, respectively, there is at least one tape between each adjacent pair of gripper fingers 98. Preferably each gripper bar 106 is recessed or grooved at 112 to receive these tapes, the depth of each groove 112 substantially equaling the thickness of the respective tape, so that the non-grooved surfaces of the gripper bars are flush with the top of the tapes. This provides a substantially flat surface for the leading portion of a sheet engaged by a gripper mechanism and thus avoids the wrinkling thereof.

The gripper mechanisms of each separating cylinder are spaced apart slightly more than two maximum sheet lengths, and are preferably equally spaced around the periphery of the cylinder. The cylinders are phased so that each gripper mechanism of one cylinder receives a sheet when that gripper mechanism is substantially equidistant from the gripper mechanisms of the other cylinder.

The separation of the two side-by-side initial streams of sheets by the cylinders 27, 29 into two side-by-side streams of sheets to be conveyed to the fan wheel 47 and two side-by-side streams of sheets to be conveyed to the fan wheel 67 is shown in FIG. 2. Gripper mechanism 90 has released the two side-by-side sheets 115, which are being conveyed to the right between the tapes 15 and 37 toward the fan wheel 67.

Gripper mechanism 87 has received the two sheets 116, closed on them and diverted them to the left. The gripper fingers 98 of gripper mechanism 88 have just received and closed on the two sheets 117, and begun to divert them to the right. Previous positions of these fingers and the leading edges of the sheets 117 in the gripping zone between the cylinders 27 and 29 are indicated as "1", "2", "3", "4", "5" and "6", and show the action of the gripping fingers engaging the sheets. In positions "3" and "4" the fingers project into the grooves 110 of cylinder 27 and the leading portions of the sheets are guided by the tapes 13, 15 and the peripheries of the cylinders 27, 29. As the cylinder 29 rotates, the fingers 98 are rotated clockwise by the cam 104 over the leading edges of the sheets (see positions "5" and "6") and securely clamp the sheets in position "7".

Thereafter the gripper mechanism 89 will engage the sheets 118 and divert them to the left. Thus as the cylinders 27, 29 rotate, successive sheets will be alternately diverted to the right and left, and there will be a minimum of one sheet length between successive sheets in each stream downstream of the cylinders. This is more than adequate to provide for slow down by the fan wheels 47 and 67.

It will be understood that the embodiment of the invention described above is merely exemplary and that persons skilled in the art may make many variations and modifications without departing from the spirit and scope of the invention. For example, a single initial stream, or three or more side-by-side streams of sheets could be delivered to the separating cylinders. Also, each separating cylinder could mount only one, or three or more gripper mechanisms. Furthermore, the separating cylinders could be of different size and driven at different speeds if the delivery tapes do not pass between them. Also, the gripper mechanisms could be arranged on the cylinders so that successive sheets are not alternately diverted to the left and right; for example, two sheets could be diverted to the right for each sheet diverted to the left. All such modifications and variations are intended to be within the scope of the invention as defined in the appended claims.

I claim:

1. A sheet handling system for dividing a stream of sheets into at least two streams of sheets comprising first and second driven sheet separating cylinders mounted for rotation about axes parallel to each other, first gripping means mounted on the first separating cylinder for engaging the leading edge of a sheet in a gripping zone disposed between the first and second separating cylinders, second gripping means mounted on the second separating cylinder for engaging the leading edge of another sheet in the gripping zone, the separating cylinders being driven in phase such that the first and second gripping means are alternately carried through the gripping zone, a pair of sheet feeding tapes, each guided in a separate closed path and wrapping around in engagement with the outer periphery of one of the cylinders, means for guiding the tapes in converging paths to receive the sheets seriatim and accelerate them to space them further apart, then guiding the tapes in parallel paths between the cylinders to support the spaced apart sheets between the tapes throughout the lengths of the sheets while carrying them through the gripping zone in timed relation to the gripping means, whereby the leading edge of the sheet is introduced into the respective gripping means and the gripping means engages the leading edge while both the leading edge and gripping means are moving at the same velocity, and then guiding the tapes in diverging paths in engagement with the respective cylinder, means for guiding the sheets from the first separating cylinder downstream of the gripping zone to a first delivery station, and means for guiding the sheets from the second separating cylinder downstream of the gripping zone to a second delivery station.

2. A sheet handling system as set forth in claim 1 in which each of the sheet feeding tapes includes a plurality of spaced apart individual tapes which engage the outer periphery of the respective separating cylinder and in which each of the gripping means includes a plurality of pivotal gripper fingers recessed in the respective cylinder between individual tapes and including a gripper bar mounted on the respective cylinder and having outer sheet engaging surfaces intermediate individual tapes and substantially flush with the outer surfaces of the adjacent tapes, whereby the sheets engage the flush surfaces of the gripper bar and tapes when gripped by the gripping fingers.

3. A sheet handling device as set forth in claim 2 including tape receiving slots in the gripper bar to accomodate the individual tapes, the depth of the slots being substantially the thickness of the tapes.

* * * * *